US006612266B2

(12) United States Patent
Brooks

(10) Patent No.: US 6,612,266 B2
(45) Date of Patent: Sep. 2, 2003

(54) HEAD STABILIZER FOR EQUESTRIAN JUMPING

(76) Inventor: Carleton Brooks, 100 Central Ave., Redwood City, CA (US) 94061-3825

( * ) Notice: Subject to any disclaimer, the term of this patent is extended or adjusted under 35 U.S.C. 154(b) by 0 days.

(21) Appl. No.: 10/007,102

(22) Filed: Dec. 4, 2001

(65) Prior Publication Data

US 2003/0101945 A1 Jun. 5, 2003

(51) Int. Cl.[7] ..... A62B 35/00; A62B 69/00
(52) U.S. Cl. ..... 119/857; 54/71; 434/247
(58) Field of Search ..... 54/71, 44.1, 1; 602/18; 119/857; 434/247

(56) References Cited

U.S. PATENT DOCUMENTS 2,742,654 A * 4/1956 Hurt ..... 441/118
3,672,075 A * 6/1972 Eikelenboom ..... 434/247
6,045,522 A * 4/2000 Grober ..... 602/18
6,093,025 A * 7/2000 Willcox ..... 434/247
6,095,819 A * 8/2000 Ferrand et al. ..... 434/247
6,315,746 B1 * 11/2001 Garth et al. ..... 602/18

* cited by examiner

*Primary Examiner*—Charles T. Jordan
*Assistant Examiner*—Kimberly S. Smith
(74) *Attorney, Agent, or Firm*—Joseph T. Guy; Nexsen Pruet Jacobs & Pollard, LLC

(57) ABSTRACT

A stabilizer for training a person in equestrian jumping. The stabilizer comprises an upper brace and a lower brace. The upper brace comprises an upper side and a lower side. The upper brace is capable of receiving a person's neck therein. The lower brace is attached to the lower side of the upper brace and extends downward from the upper brace. The lower brace comprises a rear panel which is substantially parallel to the chest of the person.

15 Claims, 4 Drawing Sheets

HEAD STABILIZER FOR EQUESTRIAN JUMPING

TECHNICAL FIELD

The present invention is related to a training device for equestrian jumping. More specifically, the present invention is related to a training device which insures proper positioning of a person's head while equestrian jumping to insure correct positioning for aesthetics.

BACKGROUND

Equestrian jumping, wherein a horse and rider traverse an obstacle course, is a widely practiced activity. It is well recognized that the artistry and intrigue of horse and rider working in concert requires that a level of risk be assumed. It is not uncommon for the horse to stumble or for the rider to become dislodged both of which can be harmful to one, or both, of the horse and rider. One common problem is the rider being manipulated into an improper position during the jump. The rider may fall off of the horse which is obviously not desirable. It is also common for the rider to brace themselves inappropriately which can cause the head to snap causing injury to the neck. In severe cases the rider may be positioned so poorly as to contribute to the horse stumbling.

Based on considerable evaluation of equestrian jumping it has become apparent to the inventors that correct positioning, during a jump, is critical to proper technique. One detriment to proper head positioning is the reaction of the rider at the point of landing wherein bracing for a sudden stop causes the rider to tense which leads to positioning problems. Training a rider to relax at landing is paramount to training a rider to being aesthetically attractive during equestrian jumping. While not limited to any theory, it is postulated that an unskilled rider watches the ground as the horse lands. This is a natural instinct. For proper positioning the head should be upright relative to the spine. The natural tendency to look down is in conflict with the desire to maintain the head in an upright position throughout the jump. Focusing attention on the ground also tends to cause the rider to tense thereby exasperating the improper positioning. Currently, riders are trained predominantly by repetition. This is time consuming, expensive, and may be detrimental to the horse since an excessive amount of jumping may cause fatigue in the horse thereby increasing the likelihood of stumbling.

Provided herein is a device which greatly increases the efficiency of training a rider in equestrian jumping.

SUMMARY

It is an object of the present invention to provide a device which assist in training a person to properly ride a horse during equestrian jumping activities.

It is another object of the present invention to provide a device which obscures the view of the horse jumping thereby requiring the rider to react to the feel of the horse as opposed to the visual interpretation of the horse movement.

A particular feature of the present invention is the light weight of the device which allows the device to be worn comfortably.

Yet another particular feature is the ease with which the device is utilized.

These and other advantages, as will be realized, are provided in a stabilizer for training a person in equestrian jumping. The stabilizer comprises an upper brace and a lower brace. The upper brace comprises an upper side and a lower side and the upper brace is capable of receiving a person's neck therein. The lower brace is attached to the lower side of the upper brace and extends downward from the upper brace. The lower brace comprises a rear panel which is substantially parallel to the chest of the person.

Another embodiment is provided in a method for training a person to be properly positioned on a jumping horse. The method comprises the steps of a) attaching a stabilizer to the neck of the person wherein the stabilizer comprises an upper brace with an upper side and a lower side capable of receiving the person's neck therein; the stabilizer also comprises a lower brace attached to the lower side of the upper brace extending downward from the upper brace wherein the lower brace comprises a rear panel substantially parallel to the person's chest and a front panel opposite to the rear panel; and b) allowing the horse to traverse an obstacle wherein the lower brace is between the person and the horse thereby limiting the forward motion of the person.

Yet another advantage is provided in a stabilizer for wearing on a person's neck while riding a horse. The stabilizer comprises an upper brace and a lower brace. The upper brace comprises an upper panel and a lower panel. The upper panel comprises a void capable of receiving the neck and the lower panel comprises a second void capable of receiving the neck. The upper panel is attached to the lower panel to form a chamber there between. The lower brace is attached to the lower panel opposite to the upper panel and extends downward between the person and the horse.

DETAILED DESCRIPTION

The present invention provides for a training aid for equestrian jumping. Particularly, the present invention provides a head stabilizer for use in equestrian jumping which insures that the head is protected from violent movement in any direction and insures proper placement throughout a jump. The training aid also provides a means to visually obscure the view of the horse which requires the rider to relax and rely on feeling the movement of the horse instead of reacting to a visual awareness of the jumping motion of the horse.

Figure 1:
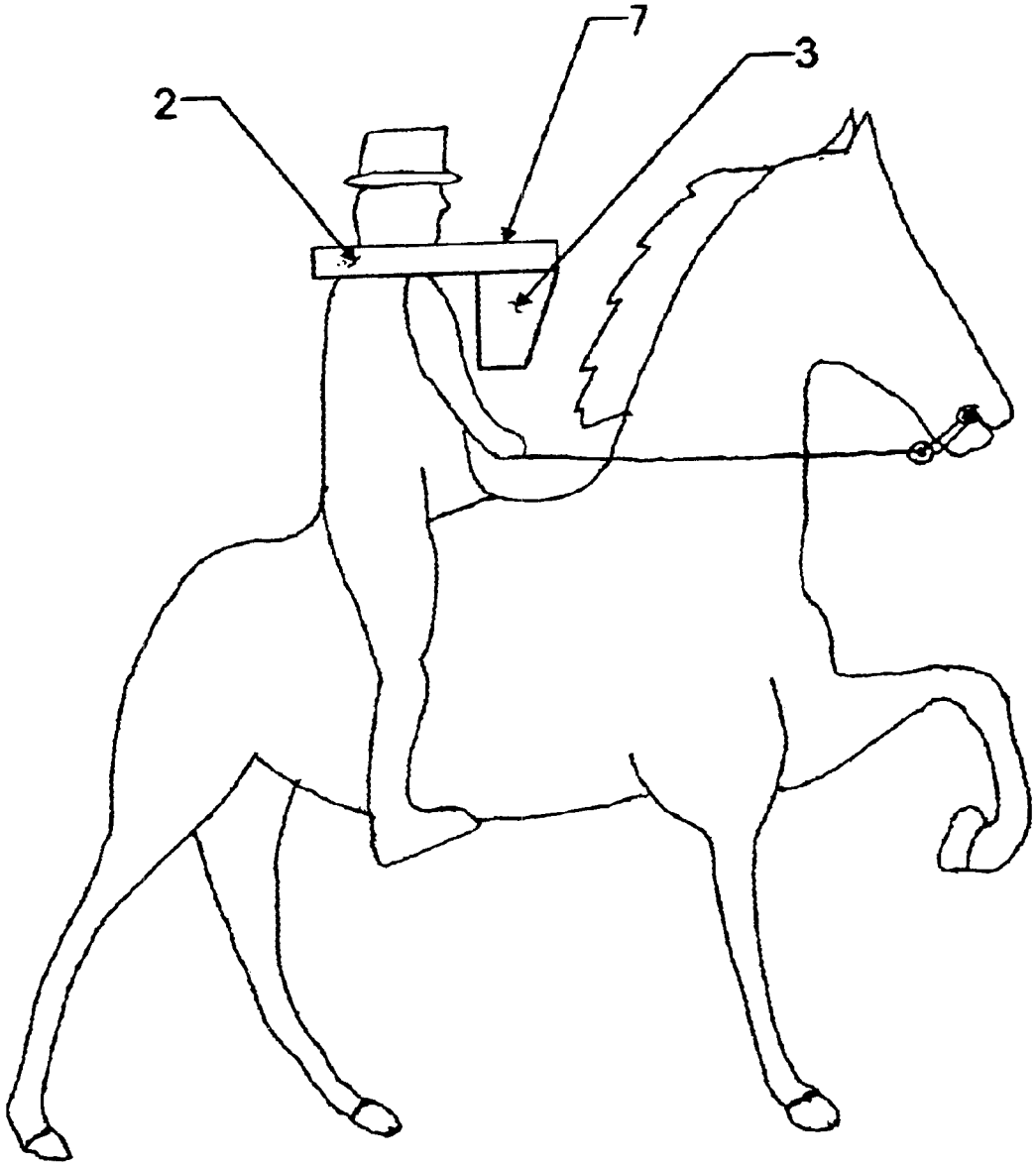
FIG. 1 is a side view of an embodiment of the present invention as it would appear during use

An embodiment of the present invention is illustrated in FIG. 1 as it would appear in use. In FIG. 1, a rider is situated on a horse as would be readily apparent to one of ordinary skill in the art. A head stabilizer, generally represented at 1, is worn around the neck of the rider. The head stabilizer, 1, comprises an upper brace, 2, which surrounds the neck, and a lower brace, 3, which is between the chest of the rider and the neck of the horse. The upper brace, 2, preferably provides two functions. A primary function is a visual obscuring function wherein the upper brace visually obscures the lower portion of the horse thereby reducing the ability of the rider to determine the location of the horses feet, particularly with relation to the ground. By not being able to rely on sight the rider must learn to rely on the movement of the horse thereby increasing the rate at which the rider rides by instinct or by feeling the movement of the horse. A secondary function is a protective function wherein the neck is secured thereby encouraging the rider to maintain the head in an upright position which improves the aesthetics of the jump.

Figure 2:
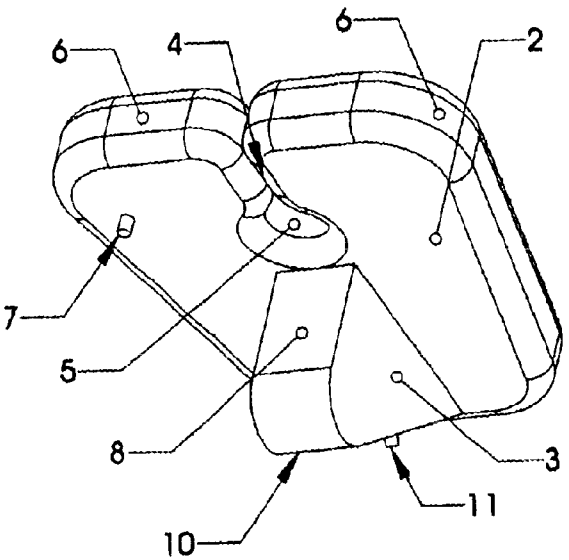
FIG. 2 is a bottom rear perspective view of an embodiment of the present invention.
Figure 3:
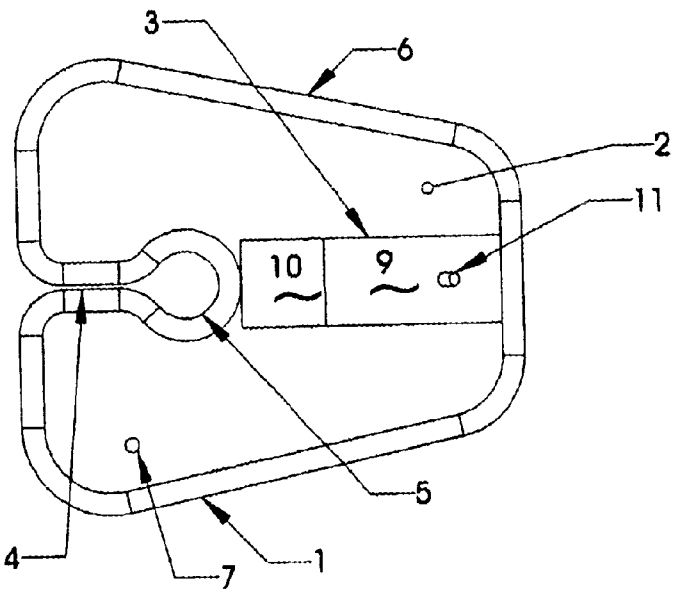
FIG. 3 is a bottom view of the embodiment of FIG. 2.
Figure 4:
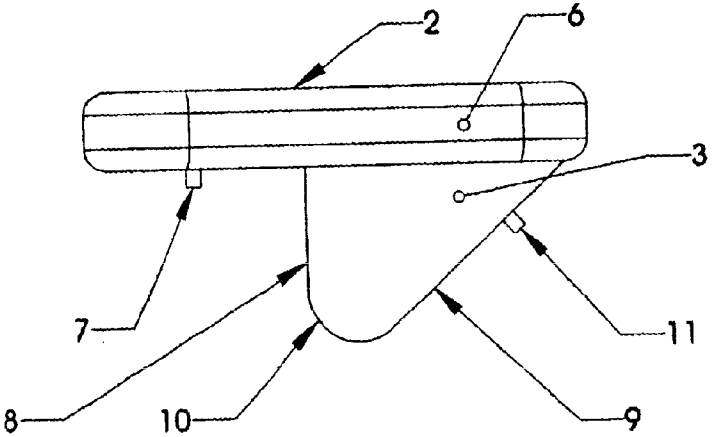
FIG. 4 is a side view of the embodiment of FIG. 2.
Figure 5:
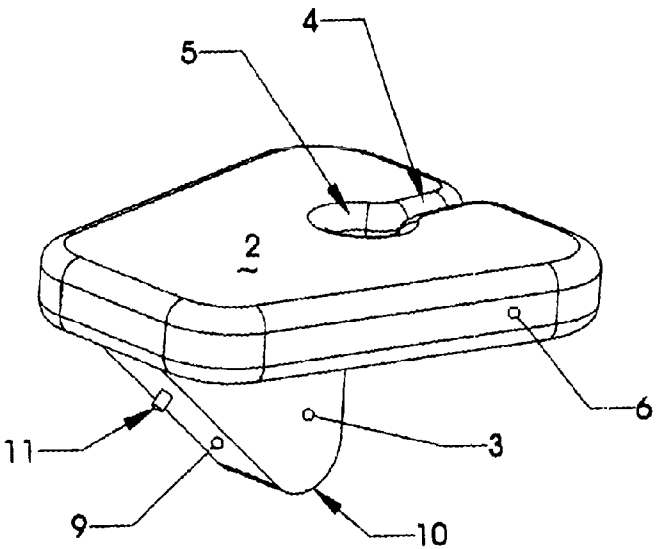
FIG. 5 is a top front perspective view of the embodiment of FIG. 2.

The head stabilizer will be described in more detail by reference to FIGS. 2–5. FIG. 2 is a bottom rear perspective view of the head stabilizer. FIG. 3 is a bottom view of the head stabilizer. FIG. 4 is a side view of the head stabilizer and FIG. 5 is a top front perspective view of the head stabilizer. The upper brace, 2, is substantially planar and flexible. At one end of the upper brace is a neck slot, 4, which is continuous with a centrally located neck void, 5, within which the neck resides during use. The upper brace must have sufficient flexibility to be able to be distorted such that the person's neck can easily slide through the neck slot, 4, without abrasions yet be strong enough to be securely positioned such that it can function in the manner described herein without being easily displaced. In use, the person would grasp the head stabilizer on either side of the neck slot to separate the neck slot thereby making a large passageway. The head stabilizer would then be placed around the neck with the neck in the neck void. The head stabilizer would then be allowed to return to rest position thereby securely grasping the person around the neck. It would be apparent that the neck void is of a sufficient size to secure the device rotationally without choking the person. Approximately 9 cm has been determined to be adequate for average adults. It would be understood that other sizes may be preferred for larger or smaller riders. The flexibility of the head stabilizer must allow for the stabilizer to come off of the neck in the event of a fall thereby avoiding injuries from the stabilizer itself.

The shape of the upper brace is preferably trapezoidal with the larger end of the trapezoid preferably facing the rear of the person and incorporating the neck slot therein. A rectangular upper brace is contemplated yet the trapezoidal shape is preferred since the narrowing towards the front facilitates grasping the reins of the horse and is more comfortable. The upper brace preferably has a maximum thickness of at least about 3 cm to no more than about 10 cm. Below about 3 cm the thickness is not sufficient to adequately protect the head from moving. Above about 10 cm the comfort of the device is compromised thereby decreasing the ability of the rider to utilize the device. Most preferably the upper brace has a maximum thickness of about 5 cm to about 8 cm. The upper brace is preferably at least about 30 cm in length from rear to front to no more than about 50 cm. If the upper brace is less than about 30 cm in length from front to rear the visual obscuring function is minimized. If the upper brace is more than about 50 cm in length the extra length contributes to weight and discomfort with no added benefit. Most preferably, the upper brace is about 35 cm to about 45 cm from front to rear. In a particularly preferred embodiment the forward most portion of the rounded void, 5, corresponds to the approximate center of the upper brace as measured from front to back. The upper brace may have substantially rounded edges, 6, or the edges may comprise multiple planar sections with seams there between which, taken together, form a substantially rounded, or chambered, edge.

The width of the upper brace is preferably at least about 15 cm at the narrowest portion and preferably no more than about 60 cm at the widest portion. Below about 15 cm the visual obscuring function is compromised. Above about 60 cm the size becomes obtrusive and the device becomes uncomfortable. Furthermore, the excess material required does not bring any substantial benefit at sizes over about 60 cm. Most preferably the upper brace is between about 20 cm and about 40 cm wide.

The material of construction is chosen based on cost, comfort, weight and other parameters realized to one of ordinary skill in the art. As apparent from the discussions herein, the material of construction is chosen to be flexible enough to be contorted for placing on the neck of the rider yet rigid enough to remain securely in the proper location while in use. Various molded materials may be used. The most preferred molded material would be open cell foam due, in part, to the low cost, light weight, and flexibility parameters which are ideally suited for the immediate device. A particularly preferred embodiment could be manufactured from an open cell foam coated with a sewn fabric. Most preferably, the upper brace is an air chamber which is filled with air to form the device. An air chamber is preferred due to the light weight, manufacturing cost, and minimal demand on storage space. An air valve, 7, integral to the upper brace allows for air to be introduced into the upper brace and removed. Air valves for pneumatic items are well known and widely available. Air valves typically comprise a tube with a seal at one end which is inserted into the tube to block the flow of air.

The upper brace is preferably opaque to obscure the view looking down as realized from the description of use. In a particularly preferred embodiment at least the upper surface of the upper brace has a material thereon to aid in comfort as the upper brace contacts the face of the rider.

The lower brace, 3, is preferably a truncated triangle in cross section and attached to the bottom of the upper brace forward of the neck void. The purpose of the lower brace is to support the upper brace and to rest against the chest of the rider to form a spacer between the chest of the rider and the neck of the horse during a jump to prohibit leaning excessively far forward. As would be realized from the teachings herein, as the horse jumps the rider leans forward relative to the horse. If the riders leans to far forward they are unable to recover when the horse lands. If the rider does not lean forward enough the momentum of the horse may be sufficient for the rider to tumble towards the rear of the horse.

The lower brace, 3, preferably comprises a rear panel, 8, which, when worn properly, is substantially parallel, and in close proximity, to the chest of the rider. Opposite to the rear panel is a front panel, 9, which is preferably at an angle relative to the rear panel. The intersection between the front panel and rear panel may be an arc section, 10, which is preferred for aesthetics. A flat section between the front panel and rear panel, substantially parallel to the upper brace is also suitable.

The lower brace is preferably not as wide as the upper brace. A lower panel of at least about 5 cm to no more than about 20 cm is preferred. Below about 5 cm the lower brace becomes to easily distorted to be effective. Larger than about 20 cm is not necessary and begins to become cumbersome with no added benefit. Most preferably, the lower brace is about 10 cm wide to about 20 cm wide. The length of the lower brace, measured from the upper brace to the lowest extent of the lower brace, is preferably about 10 cm to about 25 cm. Below about 10 cm the brace is not as effective and larger than about 25 cm there is no added benefit. Most preferably, the length of the lower brace is about 15 cm to about 20 cm.

The material of construction of the lower brace is preferably the same as the material of construction for the upper brace. Most preferably, the upper brace is an air chamber and the lower brace is a second air chamber attached thereto by welding, gluing, adhesives, hoop and latch attachment, snaps, buttons and the like. Welding is the most preferred method of attachment. A lower air valve, 11, integral to the lower brace allows for air to be introduced into the lower brace and removed.

Figure 6:
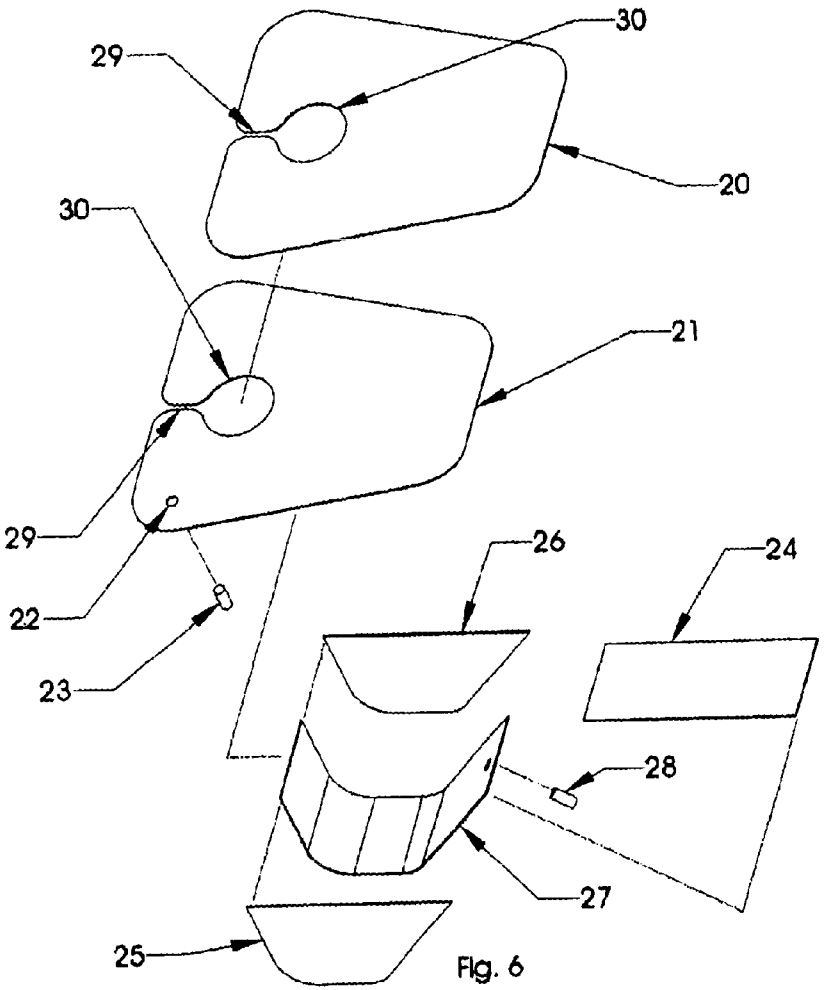
FIG. 6 is an exploded view of an embodiment of the present invention.

An embodiment of the invention is illustrated in exploded view in FIG. 6. In FIG. 6, the upper brace comprises an upper panel, 20, and a lower panel, 21. The panels are preferably substantially the same shape and size. The upper panel and lower panel each comprise a slot, 29, which connects to a neck void, 30. The upper panel and lower panel are welded one to the other around the edge thereby forming a chamber there between. An air void, 22, with air valve, 23, attached thereto allows air to be introduced into the chamber to form an air pillow in the same basic shape as the two panels which form the chamber. The lower brace comprises a cap plate, 24, matching side plates, 25 and 26, and an edge plate, 27, which are welded together at the edges to form a lower chamber which is the lower brace. An air void with associated valve, 28, secured thereto allows air to be introduced into the chamber to form an air pillow which, in cross-section, is essentially the same shape as the side plates. The edge plate, 27, may be a single unit as shown or multiple units taken together by welding or the like. A single unit is preferred due to cost considerations.

The upper panel is preferably opaque to obscure the view of the feet of the horse.

A head stabilizer comprising a single air chamber is contemplated wherein air can flow between the upper brace and lower brace. While a single chamber would be adequate and within the scope of the invention two separate chambers are preferred due, in part, to a preferred manufacturing process not necessarily due to preferred performance of the resulting product.

The invention has been described with particular emphasis drawn to the preferred embodiments. It would be apparent that various modifications, alterations and embodiments could be realized based on the teachings herein without departing from the scope of the invention which is set forth more specifically in the claims which follow.

What is claimed is:

1. A stabilizer for training a person in equestrian riding comprising:

an upper brace comprising an upper side and a lower side and capable of receiving a person's neck therein;

a lower brace attached to a lower most planar surface of said lower side of said upper brace and extending downward from said upper brace wherein said lower brace comprises a rear panel substantially parallel to a chest of said person.

2. The stabilizer for training a person in equestrian riding of claim 1 wherein said upper brace is an air chamber.

3. The stabilizer for training a person in equestrian riding of claim 1 wherein said lower brace is an air chamber.

4. The stabilizer for training a person in equestrian riding of claim 1 wherein said upper brace is at least about 30 cm in length to no more than about 50 cm in length.

5. The stabilizer for training a person in equestrian riding of claim 1 wherein said rear panel and a front panel are at an angle with respect to each other.

6. The stabilizer for training a person in equestrian riding of claim 1 wherein said upper brace is opaque.

7. A method for training a person to be properly positioned on a jumping horse comprising:

attaching a stabilizer to said person wherein said stabilizer comprises an upper brace comprising an upper side and a lower side and capable of receiving said person's neck therein; and a lower brace attached to said lower side of said upper brace and extending downward from said upper brace wherein said lower brace comprises a rear panel substantially parallel to said person's chest and a front panel opposite to said rear panel; and allowing said horse to traverse an obstacle wherein said lower brace is between said person and said horse thereby limiting the forward motion of said person.

8. The method for training a person to be properly positioned on a jumping horse of claim 7 wherein said upper brace comprises an air chamber.

9. The method for training a person to be properly positioned on a jumping horse of claim 7 wherein said lower brace comprises an air chamber.

10. The method for training a person to be properly positioned on a jumping horse of claim 7 wherein said upper brace is opaque.

11. A stabilizer for wearing on a person's neck while riding a horse comprising:

an upper brace comprising an upper panel and a lower panel wherein said upper panel comprises a void capable of receiving said neck and said lower panel comprises a second void capable of receiving said neck; and wherein said upper panel is attached to said lower panel to form a chamber there between;

a lower brace attached to a lower most planar surface of said lower panel opposite to said upper panel and extending downward between said person and said horse.

12. The stabilizer of claim 11 wherein said lower brace comprises an air chamber.

13. The stabilizer of claim 12 wherein said air chamber comprises a cap plate, side plates and an edge plate.

14. The stabilizer of claim 11 wherein said lower brace is at least about 5 cm to no more than about 20 cm in width.

15. The stabilizer of claim 11 wherein said upper panel is opaque.

* * * * *